United States Patent [19]

Henze et al.

[11] Patent Number: 4,615,287

[45] Date of Patent: Oct. 7, 1986

[54] DEVICE FOR FINISHING AT LEAST ONE LENGTHWISE EDGE OF A SHEET OF MATERIAL

[75] Inventors: Siegfried Henze, Hohenroth; Karl Müssig, Bad Königshofen; Hans Ziegler, Grossbardorf, all of Fed. Rep. of Germany

[73] Assignee: TEXPA Arbter Maschinenbaugesellschaft mbH, Saal, Fed. Rep. of Germany

[21] Appl. No.: 717,951

[22] Filed: Mar. 29, 1985

[30] Foreign Application Priority Data

Apr. 3, 1984 [DE] Fed. Rep. of Germany ..... 3412385

[51] Int. Cl.[4] ..... D05B 3/00; D05B 35/10

[52] U.S. Cl. ..... 112/121.14; 112/153; 112/308; 112/272

[58] Field of Search ..... 112/262.3, 262.2, 262.1, 112/121.14, 153, 147, 308, 309, 121.11, 121.12, 272, 254

[56] References Cited

U.S. PATENT DOCUMENTS

| | | | |
|---|---|---|---|
| 2,738,746 | 3/1956 | MacIsaac, Jr. et al. | 112/121.14 |
| 3,020,864 | 2/1962 | Katz | 112/153 |
| 3,417,645 | 12/1968 | Brock | 112/121.14 X |
| 3,579,876 | 5/1971 | Freermann | 112/153 X |
| 3,609,373 | 9/1971 | Desai et al. | 112/153 X |
| 3,636,898 | 1/1972 | Connor, Jr. | 112/153 |
| 4,166,423 | 9/1979 | Brienza et al. | 112/254 |
| 4,363,281 | 12/1982 | Reinke | 112/272 X |
| 4,495,877 | 1/1985 | Willenbacher | 112/121.11 |
| 4,546,716 | 10/1985 | Babson et al. | 112/147 X |

FOREIGN PATENT DOCUMENTS

| | | | |
|---|---|---|---|
| 929758 | 5/1982 | U.S.S.R. | 112/153 |

*Primary Examiner*—H. Hampton Hunter

*Attorney, Agent, or Firm*—Quaintance, Murphy & Presta

[57] ABSTRACT

A device for the finishing of at least one lengthwise edge of a sheet of material, which at least on the one lengthwise edge has a lengthwise strip which is thinner than the remainder of the sheet of material, in that the finished lengthwise edge runs parallel to the lengthwise edge of the sheet to the side bordering the different material thicknesses, and at least two scanning devices are provided, responsive to the variations of thickness of the sheet. One scanning device is arranged to scan the lengthwise strips of the sheet which are thinner and the other scanning device is arranged to scan the sheet in its area of greater thickness. The two scanning devices are positioned transverse to the direction of movement of the sheet and are spaced so that they normally scan the sheet close to the lengthwise edge thereof, on the side bordering the different material thicknesses. If the lengthwise edge deviates to the side in one or the other direction, one or the other scanning device responds, and a drive motor is actuated correspondingly to cause the transverse adjustment of the finishing units, including the scanning devices. In this manner, the sheet is finished on the lengthwise edge exactly parallel to the adjacent lengthwise edge bordering the different material thicknesses on the side.

16 Claims, 7 Drawing Figures

DEVICE FOR FINISHING AT LEAST ONE LENGTHWISE EDGE OF A SHEET OF MATERIAL

BACKGROUND OF THE INVENTION

The invention relates to a device for finishing at least one lengthwise edge of a sheet of material, which at least on this lengthwise edge has a lengthwise strip of material which is less thick than the remainder of the sheet of material, including a plurality of finishing units arranged one after the other in the direction of conveyance of the sheet of material, on a common support, and this support can be adjusted transversely to the sheet of material by a drive motor, which can be controlled by a scanning system which monitors the edge of the sheet of material before the finishing units and is connected with the support, so that the finishing units follow deviations in the side of the sheet of material.

A device of this sort is known from German DE-OS No. 30 47 693. The two parallel edges of a sheet of material are finished by using this device. Several finishing units are associated with each edge of the sheet of material, of which the setting is controlled transverse to the sheet of material by a single scanning device. These scanning devices have optical barriers scanning the lengthwise edges of the sheet of material. If the illumination of the photoelectric elements by these optical barriers is interrupted, showing that the lengthwise edge of the sheet of material has moved to the side, then the drive motor for the transverse setting of the finishing unit is shifted so that, by following the optical barrier, its photoelectric element is illuminated again. The finishing unit (e.g., including a hemmer and a sewing machine) likewise follows the deviation of the lengthwise edge of the sheet of material, so that the finishing can be continued. This known device can work satisfactorily when sheets of material with the two perfectly straight parallel lengthwise edges are to be treated.

However, if the sheets of material have curved lengthwise edges and do not run parallel and still have not been trimmed, and furthermore have lengthwise strips of material on their lengthwise edges that are thinner than the remainder of the sheet of material, then the finishing could damage the sheet or the installation itself during the operation. With a curved lengthwise edge of the sheet of material, even optical barriers connected tightly with the support for the finishing unit which can be set transversely move correspondingly to the side, which results in a correspondingly uneven or curved finishing (hemming and sewing) of the lengthwise edge, and the lengthwise edge which is so treated is not parallel to the adjacent lengthwise edge (e.g., nap-edge) of the sheet of material which is to the side of and bordering the different material thicknesses. A sheet of material which is so treated yields a defective product.

SUMMARY OF THE INVENTION

An object of the present invention is to provide a device for finishing at least one lengthwise edge of a sheet of material, which at least on this lengthwise edge has a lengthwise strip which is thinner than the remainder of the sheet of material, and the finished lengthwise edge or the respective lengthwise edge is to run without distortion parallel to the lenghtwise edge bordering the different material thicknesses of the strip on the side.

According to the invention, this object is attained by a device of the aforementioned type of structure, wherein:

(a) the scanning system has at least two scanning devices which are responsive to the thickness variations of the sheet of material, of which the one is arranged to scan the lengthwise strips of the sheet of material in its area of smaller thickness and the other is arranged to scan the sheet of material in its area of greater thickness, and (b) the two scanning devices are positioned transversely to the direction of forward movement of the sheet of material, spaced so slightly that they normally scan the sheet close to the lengthwise edge of the sheet of material lying to the side of and bordering the different material thicknesses.

The scanning system according to the invention is not, as in the present state of the art, oriented on the possibly uneven lengthwise outside edge of the sheet of material, but rather is oriented on the lengthwise edge (e.g., nap edge) of the sheet of material bordering the different material thicknesses on the side. If this lengthwise edge deviates in one or the other direction, one or the other scanning device is responsive and the drive motor controlling the transverse setting of the finishing unit, including the scanning devices, is correspondingly shifted. The result is that the sheet of material is finished on its lengthwise edges exactly parallel to the lengthwise edges (e.g., nap edges) of the sheet of material bordering the different material thicknesses to the side. With a sheet of which the lengthwise outside edges run unevenly, these are also parallel to the trimmed lengthwise edges bordering the different material thicknesses to the side. In devices for finishing both lengthwise edges of a sheet of material, the scanning devices according to the invention are mirror-inverted and symmetrically arranged.

The device of the present invention can advantageously be used for finishing sheets of material of various different thicknesses. It can also be used for the finishing of sheets of material which have alleys of smaller thicknesses of material running at certain spacings transversely to the direction of movement. The scanning device which is cooperating with these alleys, when it meets such a condition, makes the other passing scanning devices inactive, so that the associated drive motor for the transverse setting of the finishing unit does not operate. These therefore pass by their various setting position.

In accordance with a refinement of the invention, because of a long lever translation of the control member, it is possible for the electric switch, itself of relatively low height differential, to contact the sheet of material. There is also provided a structurally simple solution which is easy to maintain, in order to set the scanning devices on areas of different thickness of the sheets of material.

Further, the toggle levers of the scanning devices can cooperate alternately with electrical induction switches, photoelectric switches, road signal switches or the like. Also, the scanning devices can instead have mechanical contacts, or pneumatically or ultrasonically responsive contacts or photoelectric scanning elements. For the finishing of both lengthwise edges of a sheet of material, the scanning devices can be arranged mirror-inverted and symmetrical, in a known manner.

BRIEF DESCRIPTION OF THE DRAWINGS

The invention is explained hereinafter relative to the drawings of one exemplary embodiment. They show.

DESCRIPTION OF THE PREFERRED EMBODIMENTS

Figure 1:
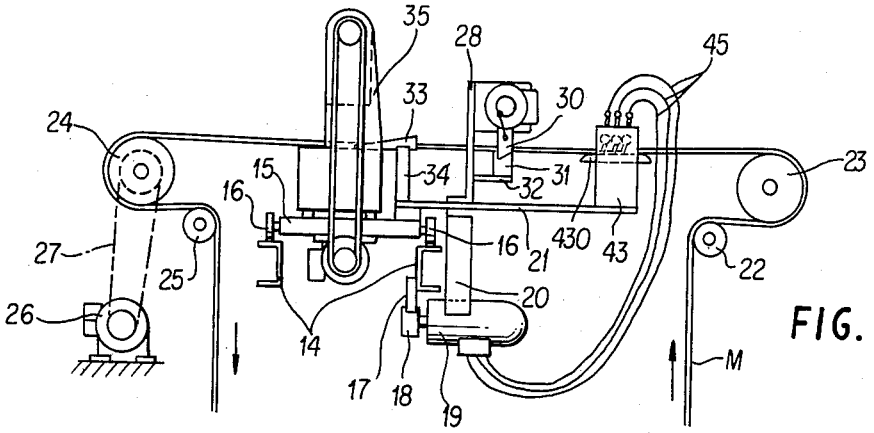
FIG. 1 is a side elevational view of a device for finishing both lengthwise edges of a sheet of textile material, which includes the scanning system according to the present invention.
Figure 2:
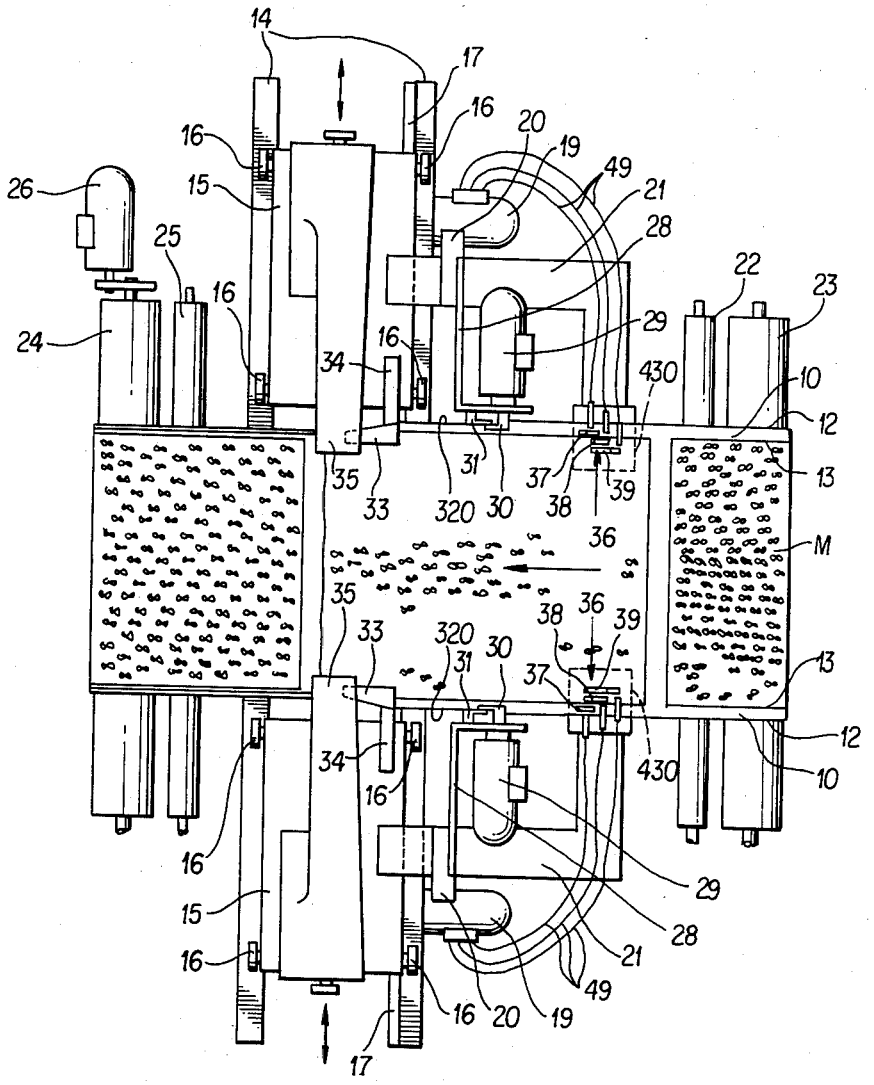
FIG. 2 is a plan view of the device shown in FIG. 1.
Figure 3:
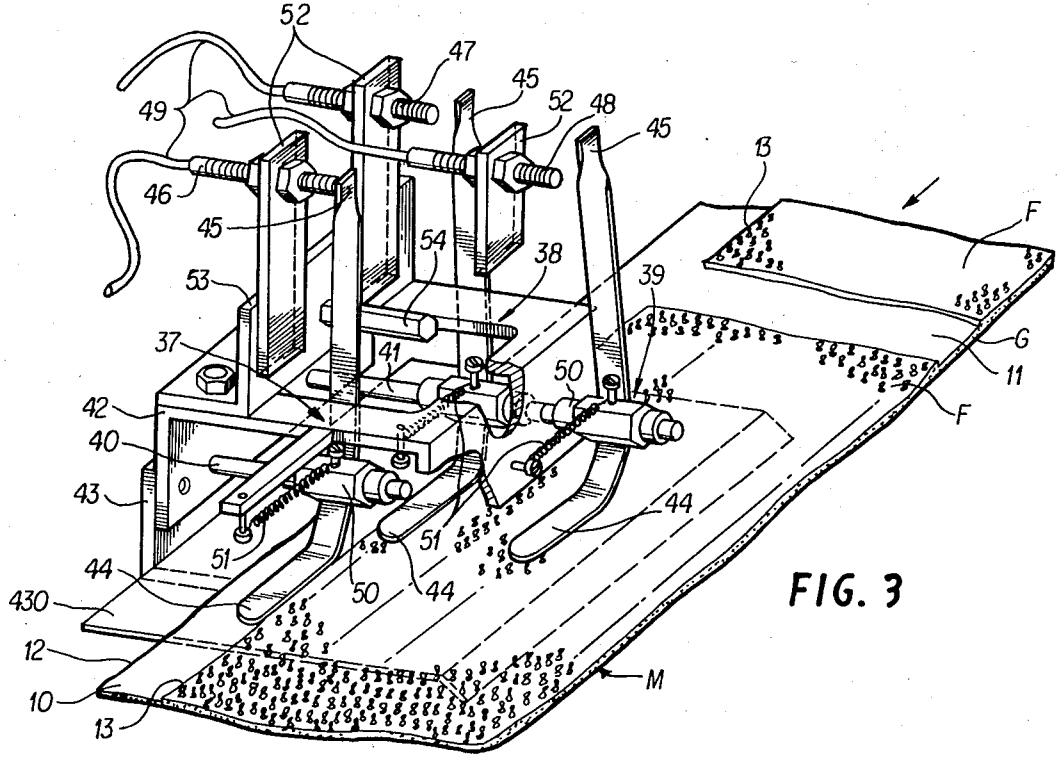
FIG. 3 is a perspective view of the scanning devices of the system according to the present invention, facing a lengthwise edge of the sheet of material in operative connection, with a cutout of a textile sheet of material.

In the device selected as an exemplary embodiment and shown in FIGS. 1 and 2, a sheet M of textile material is being finished, wherein sponge towelettes are shown separated into individual pieces. The sheet M thus includes a wavy support G, which supports nap interfaces F, as shown in FIG. 3. Nap interfaces F are of such dimensions and are arranged on support G so that lengthwise strips 10 of support G remain free facing the lengthwise edges of these nap interfaces. Furthermore, nap-free alleys 11 extend transversely to the direction of forward movement of sheet M (as indicated by arrows in FIGS. 1–3), and these alleys separate the individual nap interfaces F from each other. In these nap-free alleys 11, sheet M is separated by a cutting device which is not relevant here and therefore is not shown. As a result of this, both lengthwise edges 12 of sheet M are found on the nap-free lengthwise strips 10 of support G. On both lengthwise strips 10 and nap-free alleys 11, sheet M is thinner than on the nap interfaces F, which is important for the scanning method to be described hereinafter.

With the device shown in FIGS. 1 and 2, both lengthwise edges of sheet M are being finished, and it is to be noted that the two lengthwise edges 12 are not, as desired, always even and parallel to each other before introduction of sheet M into the finishing device, but also can be curved and other than parallel. On the other hand, lengthwise edges 13 of nap interfaces, which border the different thicknesses of sheet M to the side, extend facing each other, instead of parallel to each other. These lengthwise edges 13 are drawn as reference edges for the scanning system according to the present invention, still to be described.

The finishing device has two U-shaped rails 14, fastened on frames (not shown), which are spaced apart and parallel transverse to the direction of movement of sheet M, shown in FIG. 2 by an arrow. Two supports 15 for the individual finishing units can be moved on these rails 14 to the side and beneath sheet M. Supports 15 each have four rollers 16 for this purpose, by which they can be moved back and forth as trolleys on rails 14. On the right rail 14 in FIGS. 1 and 2 is fastened a rack 17. Pinions 18, fastened on the shafts of two drive motors 19, mesh with this rack 17. Each drive motor 19 can work in both directions of rotation. Supports 15 are therefore moved away when drive motors 19 are connected, in accordance with the direction of rotation of pinion 18 toward or away from sheet M.

The finishing unit of the exemplary embodiment also serves for trimming, hemming and sewing the two folded lengthwise edges of sheet M. The sheet is carried through the individual finishing stations (FIG. 1) in the longitudinal direction, flat and horizontal. As a detail, sheet M runs from a supply roll (not shown) over two guide rollers 22, 23 to a drive roller 24 and over another guide roller 24 downward again in the direction of the arrow to the next treatment station (not shown). Drive roller 24 for sheet M is moved counterclockwise over an endless belt 27 by a drive motor 26 as shown in FIG. 1. Rollers 22–25 are rotatably mounted on the frame (not shown) of the device and drive motor 26 can also be fastened to this frame.

First, during introduction of sheet M into the finishing device, both lengthwise edges 12, which may run curved and not parallel to each other, are so trimmed that they extend parallel to each other and to the lengthwise midline of sheet M. For this purpose, a holder 28 extending upwardly and against sheet M, is fastened on each arm 20, which supports a drive motor 29, on the shaft of which is mounted a cutting blade 30. This rotating cutting blade 30 cooperates with a stationary blade 31, which is supported by an arm 32 mounted on holder 28. Lengthwise edges which are trimmed and run parallel to each other are indicated as 320 in FIG. 2.

The two lengthwise edges of sheet M are hemmed in hemming devices 33, which are connected with support 15 by brackets 34. Sewing machines 35 are arranged in the direction of forward movement of sheet M behind hemming devices 33, where they sew the folded lengthwise edges of sheet M, and each is mounted on a support 15. From the aforementioned description, it will be seen that a cutting device, hemming device and sewing machine are each connected with a support 15. Furthermore, it is to be noted that all of the parts of the finishing unit on both sides of sheet M are arranged in mirror-inverted symmetry.

The control of the two drive motors 19 for movement of support 15 on rails 14 against sheet M toward or away from this results from a scanning system 36, which in the exemplary embodiment includes three scanning devices 37, 38 and 39, associated with a drive motor 19. The three scanning devices 37–39, adjacent to a lengthwise edge of sheet M, are shown in detail in FIG. 3. From FIG. 3, it is to be seen that scanning devices 37, 38 and 39 have similar toggle levers which are pivotable around axes 40 and 41. Axes 40 and 41 extend at a right angle to the direction of forward movement of sheet M, and parallel to its plane of movement, and are fastened to a holder 42, which is fastened to a bracket 43. Bracket 43 is mounted on the right-angle arm 21, which in turn is connected with support 15. Therefore, scanning devices 37–39 can also be moved back and forth, the same as the individual finishing units of support 15 described above, transversely to the direction of movement of sheet M.

One arm of the toggle levers of scanning devices 37–39 forms a contact or a contact foot 44, while the other arm of each toggle lever represents controls 45 for electric induction switches 46, 47 and 48, which in turn are all connected by electric cable 49 with one of the drive motors 19. Between holder 42 and bushings 50 for the toggle lever, inserted springs 51 hold contact foot 44 against sheet M, which is supported by a plate 430 fastened to bracket 43. In the exemplary embodiment, the toggle lever of scanning device 39 is mounted on the same axis 41 as the toggle lever of scanning device 38. Alternately, it can also be arranged on its own axis, which, in the direction of movement of sheet M, must be positioned before the axis 41. Electric induction switches 46, 47 and 48 are fastened to plates 52. Plates 52 of induction switches 46 and 47 are fastened directly to a toggle lever 53, while plate 52 for induction switch 48 is tightly connected through a bolt 54 with toggle lever 53. Toggle lever 53 in turn can be adjusted parallel to the direction of movement of sheet M on holder 42. Thus, electric induction switches 46, 47 and 48 can be set by their control members 45, and the scanning systems can be adapted to different sheets of material with various thicknesses in the areas of lengthwise strips 10 and nap interfaces F.

Figure 5A:
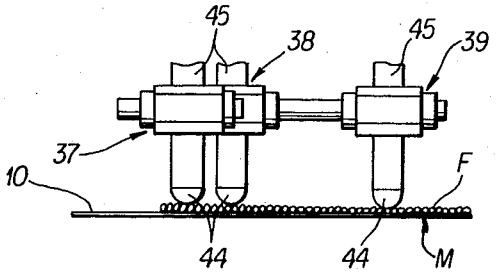
FIGS. 4–7 are front elevational and plan views of essential portions of the scanning devices shown in FIG. 3, in various work phases.
Figure 5B:
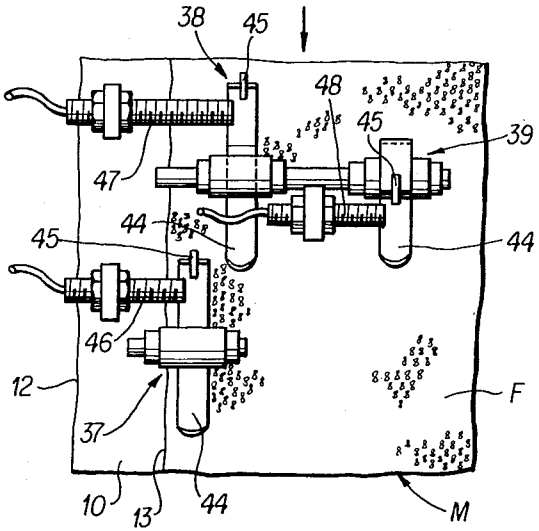
Figure 4A:
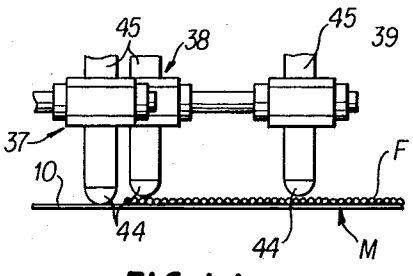
Figure 4B:
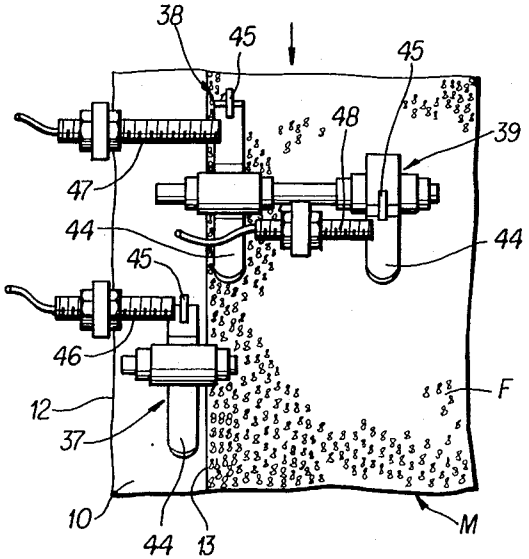

Contact feet 44 of scanning devices 37 and 38 are spaced only very slightly (some few millimeters) and are transverse to the direction of movement of sheet M. Contact foot 44 of scanning device 37 is arranged to scan lengthwise strips 10 of support G, while contact foot 44 of scanning device 38 is arranged to scan the relatively thicker nap interface F. Because of the slight side spacing of these two contact feet 44, they normally work tightly against the lengthwise edges 13 of nap interfaces F. This condition is also shown in FIG. 4 wherein the associated drive motor 19 is disconnected and the respective support 15 is seen with the finishing units in rest position. However, when sheet M deviates, e.g., to the left, as in FIG. 5, in the area of scanning devices 37, 38, the contact foot 44 of scanning device 37 is raised onto the "higher" nap interface F of sheet M, and the respective toggle lever is rotated somewhat in clockwise direction, as in FIG. 3, and its contact member 45 connects induction switch 46. The respective drive motor 19 is thus shifted so that it moves support 15 away from sheet M. This outward movement of support 15 continues until contact foot 44 of scanning device 37 is again found over lengthwise strips 10 at a lower height. Associated spring 51 then must rotate the corresponding toggle lever as in FIG. 3 somewhat counterclockwise, so that its control member 45 again disconnects induction switch 46. Thus, drive motor 19 and therefore also support 15 come to a stop.

Figure 6A:
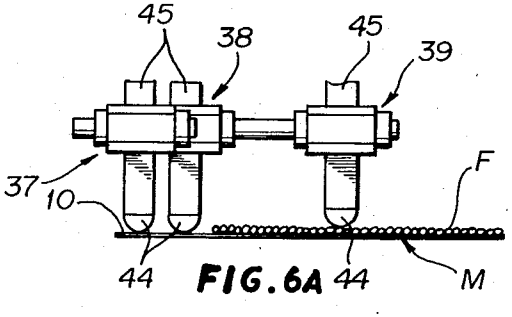
Figure 6B:
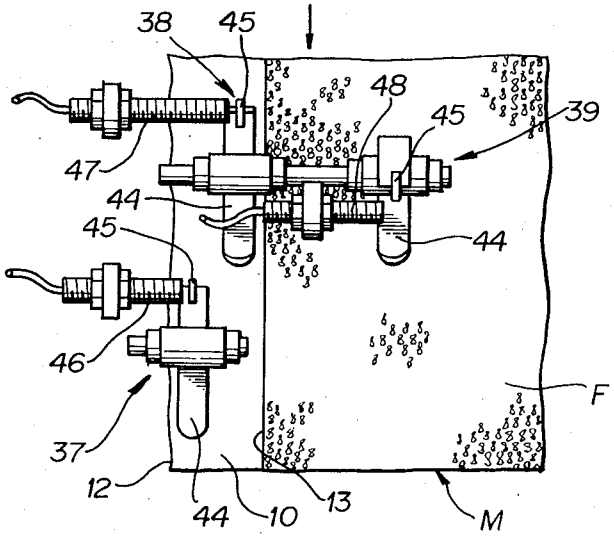

The opposite is shown in FIG. 6, wherein sheet M deviates to the right in the area of scanning devices 37, 38, and contact foot 44 of scanning device 38 comes into lengthwise strips 10 of sheet M and indeed comes under the influence of spring 51. Thus, the respective control member 45 connects induction switch 47, which in turn shifts the associated drive motor 19, so that this moves support 15 toward sheet M. This movement of support 15 lasts until contact foot 44 of scanning device 38 is again positioned over nap interface F. When this occurs, rotation of the respective toggle lever in the clockwise direction brings its control member 45 again outside the area of influence on induction switch 47, which thus disconnects the respective drive motor 19, so that support 15 again comes to a stop. The condition shown in FIG. 4 is then reached, in which contact feet 44 of scanning devices 37 and 38 work closely with lengthwise edges 13 of nap interfaces F. This guarantees that the trimmed lengthwise edges 320 run at the same distance from the adjacent nap lengthwise edges 13 as well as being parallel to each other. The product can then be hemmed and sewed without difficulty.

Figure 7B:
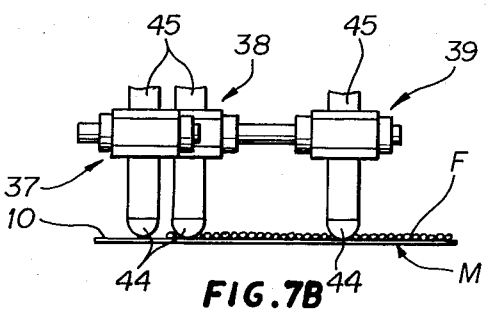
Figure 7B:
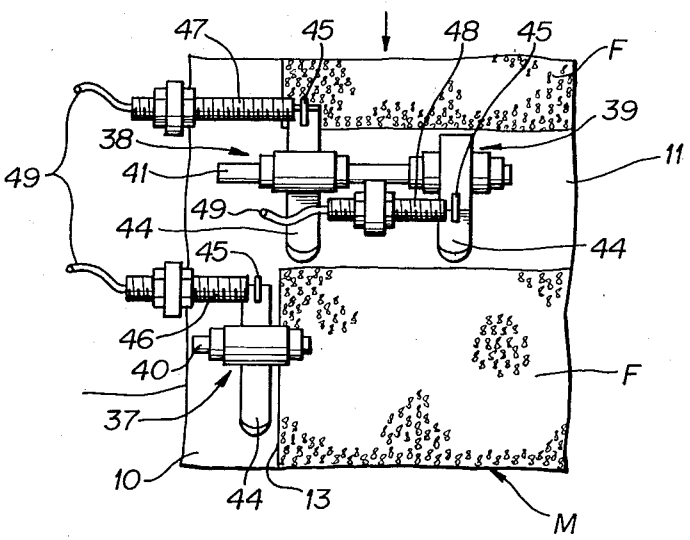

Scanning devices 39 are provided in order to avoid drive motors 19 being turned on when contact feet 44 of scanning devices 38 drop into the transverse nap-free alleys 11. As soon as contact foot 44 of the toggle lever of the scanning devices 39 engages in a nap-free alley 11, control member 45 of the respective toggle lever connects induction switch 48, which bridges over both other induction switches 46 and 47 and makes them inactive, so that drive motors 19 remain disconnected. This condition is shown in FIG. 7. As soon as contact foot 44 again reaches scanning devices 39 on the raised nap interface F, induction switch 48 is disconnected and induction switches 46 and 47 are again ready for operation.

FIG. 3 shows that the arms of toggle levers of scanning devices 37, 38 and 39 serving as control members 45 are many times longer than the arms of toggle levers forming the contact feet 44, so that even relatively slight height differentials on the top of sheet M are picked up by the scanners according to the present invention. In other words, for the operation of the scanning system according to the invention, it sufficies to already have only a slight height differential between lengthwise strips 10 and nap-free alleys 11 and nap interfaces F of sheet M.

The exemplary embodiment has been described in the context of a textile sheet of material. The scanning system according to the present invention, however, can also be used for other sheets of material, e.g., plastic foil, plastic textile sheets or the like.

What is claimed is:

1. A device for the finishing of at least one lengthwise edge of a sheet of material, especially a sheet of a textile material, which at least on the one lengthwise edge has a lengthwise strip which is thinner than the remainder of the sheet of material, wherein the device includes a plurality of finishing units arranged one after the other in the direction of movement of the sheet of material, a common support for the finishing units which can be adjustable by a drive motor in a direction transverse to the movement of the sheet of material, and a scanning system connected with the support for controlling its movement by monitoring the sides of the sheet of material before the finishing units so that the finishing units follow deviations of the sheet of material to the side, characterized in that:

(a) the scanning system has at least two scanning devices (37, 38) responsive to variations of thickness of the sheet (M) of material, one scanning device (37) being arranged to scan the lengthwise strip (10) of sheet (M) which is of less thickness, and the other scanning device (38) being arranged to scan sheet (M) in its area (F) of greater thickness, and (b) the two scanning devices (37, 38) are positioned transverse to the direction of movement of sheet (M), and are spaced so that they normally scan the sheet close to the lengthwise edge (13) of sheet (M) lying to the side of and bordering the different material thicknesses of the sheet.

2. The device as in claim 1, characterized in that scanning devices (37, 38) can be aligned on various thicknesses of material of the sheet.

3. The device as in claim 1, characterized in that scanning devices (37, 38) are arranged at some distance from each other in the direction of movement of sheet (M) of material.

4. The device as in claim 1, characterized in that for the finishing of a sheet (M), which has alleys (11) of less thickness, running at certain spacings transverse to the direction of sheet movement, at least one more scanning device (39) is provided that is responsive to variations of thickness of sheet (M), said scanning device (39) being arranged to the side of monitoring scanning device (38) in the direction toward the sheet midline next to sheet (M) in its area (F) of greater thickness, said scanning device (39) being operable to make the other scanning devices (37, 38) pass by without action when it scans an alley (11) of less thickness.

5. The device as in claim 4, characterized in that said scanning devices (37–39) have toggle levers of which the rotary axes (40, 41) are arranged at right angles to the direction of movement of sheet (M) and parallel to their plane of movement, each toggle lever comprising one arm that forms a contact (44) held against sheet (M) and another arm that forms a control member (45), and electric switches (46–48) are connected to the control member (45) and are connected to the drive motor (19) for the support (15).

6. The device as in claim 5, characterized in that the contact of each toggle lever is configured as a contact foot (44).

7. The device as in claim 5, characterized in that the contacts (44) of the toggle levers are held by the force of springs (51) against sheet (M).

8. The device as in claim 5, characterized in that the arms of the toggle levers serving as control members (45) are several times longer than the arms of the toggle levers forming contacts (44).

9. The device as in claim 5, characterized in that the electric switches (46–48) are adjustable relative to the associated control members (45) of the toggle levers.

10. The device as in claim 5, characterized in that the toggle levers are operatively connected with electric induction switches (46–48).

11. The device as in claim 5, characterized in that the toggle levers are operatively connected with photoelectric switches.

12. The device as in claim 5, characterized in that the toggle levers are operatively connected with road signal switches.

13. The device as in claim 1, characterized in that the scanning devices have pneumatic scanning elements.

14. The device as in claim 1, characterized in that the scanning devices have scanning elements responsive to ultrasound.

15. The device as in claim 1, characterized in that the scanning devices have photoelectric scanning elements.

16. The device as in claim 1, characterized in that for finishing of both lengthwise edges of sheet (M), scanning devices (37, 38) are arranged mirror-inverted and symmetrical.

* * * * *